US006477759B2

(12) United States Patent
Hu

(10) Patent No.: US 6,477,759 B2
(45) Date of Patent: Nov. 12, 2002

(54) METHOD FOR PROCESSING A HAND TOOL

(76) Inventor: Bobby Hu, P.O. Box 63-247, Taichung (TW)

( * ) Notice: Subject to any disclaimer, the term of this patent is extended or adjusted under 35 U.S.C. 154(b) by 0 days.

(21) Appl. No.: 09/758,564

(22) Filed: Jan. 11, 2001

(65) Prior Publication Data

US 2001/0001892 A1 May 31, 2001

Related U.S. Application Data

(63) Continuation-in-part of application No. 09/440,229, filed on Nov. 15, 1999, now abandoned.

(51) Int. Cl.[7] ..... B21B 1/46
(52) U.S. Cl. ..... 29/527.2; 76/119; 451/29
(58) Field of Search ..... 29/527.2, 530; 76/114, DIG. 2, DIG. 4, 119, 101.1; 427/289, 290, 299, 331, 355, 367, 444; 433/166, 10; 451/29

(56) References Cited

U.S. PATENT DOCUMENTS

| | | | | | |
|---|---|---|---|---|---|
| 1,578,254 | A | | 3/1926 | Bennett | |
| 1,746,751 | A | | 2/1930 | Derhoef | |
| 1,792,082 | A | | 2/1931 | Fink et al. | |
| 2,027,922 | A | | 1/1936 | McNaught | |
| 2,039,141 | A | * | 4/1936 | Brault | 76/119 |
| 2,161,163 | A | | 6/1939 | Hedgpeth | |
| 2,218,069 | A | * | 10/1940 | Mooney | 76/119 |
| 2,720,799 | A | | 10/1955 | Pfost | |
| 2,774,259 | A | | 12/1956 | Caulkins | |
| 3,885,359 | A | * | 5/1975 | Reekes et al. | 51/328 |
| 4,061,507 | A | | 12/1977 | Allmendinger | |
| 4,189,815 | A | * | 2/1980 | Seelenbinder | 492/37 |
| 4,274,309 | A | | 6/1981 | Lenker | |
| 4,333,807 | A | * | 6/1982 | Suzuki et al. | 204/488 |
| 4,420,520 | A | | 12/1983 | Jones et al. | |
| 4,681,600 | A | * | 7/1987 | Rhoades et al. | 51/293 |
| 5,394,654 | A | * | 3/1995 | Shimbara et al. | 451/6 |
| 5,458,713 | A | | 10/1995 | Ojster | |
| 5,480,722 | A | | 1/1996 | Tomonaga et al. | |
| 5,704,787 | A | * | 1/1998 | Hickok et al. | 427/250 |
| 5,885,395 | A | | 3/1999 | Western | |
| 5,915,743 | A | * | 6/1999 | Palma | 29/530 |
| 5,993,904 | A | | 11/1999 | Boucher | |
| 6,067,888 | A | * | 5/2000 | Achtergerg et al. | 76/112 |
| 6,227,435 | B1 | * | 5/2001 | Lazarz et al. | 228/125 |

* cited by examiner

*Primary Examiner*—S. Thomas Hughes
*Assistant Examiner*—Marc Jimenez
(74) *Attorney, Agent, or Firm*—Alan Kamrath; Rider, Bennett, Egan & Arundel, LLP

(57) ABSTRACT

A method is provided for processing a handle tool. Raw material formed into the hand tool is firstly hardened by heat treatment. A surface of the hand tool is polished after hardening. A layer of metal is deposited on the surface of the polished hand tool to provide an anti-rust effect and/or anti-corrosion effect. A local area of the layer of metal deposition on the surface of the hand tool that is grasped during use is sanded to provide an anti-slide section. A numerical size area of the hand tool is covered by a local sanding mask before local sanding to thereby form a clear numerical size mark in the local area after local sanding.

23 Claims, 17 Drawing Sheets

A

B

D

E

METHOD FOR PROCESSING A HAND TOOL

CROSS REFERENCE TO RELATED APPLICATION

This is a continuation-in-part application of U.S. patent application Ser. No. 09/440,229, filed on Nov. 15, 1999, which is now abandoned.

BACKGROUND OF THE INVENTION

1. Field of the Invention

The present invention relates to a method for processing a hand tool to provide a hand tool with improved characteristics, such as providing a firm grasp during use, cleanness-keeping capability, anti-corrosion capability, and clear indication of numerical size.

2. Description of the Related Art

FIG. 1 of the drawings illustrates a conventional combination wrench treated with surface polishing to provide a mirror-like surface. This may attract the user, and wrenches thus treated can be sold at a higher price. In order to provide the surface with an anti-corrosion effect, a deposition layer 2 (FIG. 1A) is applied after the surface polishing procedure to form a metal layer on the overall surface area of the hand tool. However, both hands of a user of the combination wrench may be covered in varying degrees with grease or oil and thus cannot firmly grasp the combination wrench treated with surface polishing and/or electric deposition. Others might be injured by a wrench falling from high places.

FIG. 2 illustrates another conventional combination wrench 1 having a handle 11 with embossed lateral sides 111 to increase grasp capability during use, but the result is found unsatisfactory during manual rotation of the handle. In addition, the user may feel uncomfortable when grasping the handle with the embossed lateral sides 111 and might even be injured.

FIG. 3 illustrates a conventional socket with an annular embossed section to increase grasp capability. The wrench (FIG. 2) and the socket (FIG. 3) are often treated with deposition (see the metal layer 2 in FIGS. 2A and 3A) to provide an anti-corrosion effect. The metal layer 2 is deposited in the embossed section and thus adversely affects the intended friction between the embossed section and the user's hand. The costly embossing processing is thus in vain.

FIG. 4 illustrates a further conventional combination wrench treated with metal sanding to provide increased grasp capability. When the wrench is further treated with deposition (see the metal layer 2 in FIG. 4A) for providing an anti-corrosion effect, the irregular surface for increasing friction between the handle and the user's hand is filled with the metal layer 2 and thus loses the required grasp capability.

FIG. 5 is a side view of a conventional socket with a numerical size (12) marked thereon. The mark (usually a cavity-like arrangement) of the numerical size is formed during formation of the socket by rolling. The surface of the socket is deposited with a deposition layer to provide a contrast to the mark of the numerical size. Nevertheless, the contrast effect is not obvious when the socket is not used in a bright place. In addition, the numerical size mark thus formed is not so easy to find by a skilled user over 40 years old.

The present invention is intended to provide a method for processing a hand tool to provide a hand tool without the above-mentioned drawbacks.

SUMMARY OF THE INVENTION

It is a primary object of the present invention to provide a method for processing a hand tool to provide a reliable grasp capability after surface polishing and deposition of the hand tool.

It is another object of the present invention to provide a method for processing a hand tool to provide a clear indication of numerical and physical size of the hand tool.

In accordance with a first aspect of the invention, a method for processing a hand tool comprises:

(a) forming raw material into a hand tool;

(b) hardening the raw material formed into the hand tool by heat treatment;

(c) polishing a surface of the hand tool after hardening;

(d) depositing a layer of metal on the surface of the polished hand tool to provide an anti-rust effect; and (e) sanding the deposited layer on the surface of the hand tool at a local area of the hand tool that is grasped during use.

The deposited layer of metal may be nickel or copper.

In accordance with a second aspect of the invention, a method for processing a hand tool comprises:

(a) forming raw material into a hand tool;

(b) hardening the raw material formed into the hand tool by heat treatment;

(c) polishing a surface of the hand tool after hardening;

(d) depositing a layer of metal on the surface of the polished hand tool to provide an anti-corrosion effect; and (e) sanding the deposited layer on the surface of the hand tool at a local area of the hand tool that is grasped during use.

In accordance with a third aspect of the invention, a method for processing a hand tool comprises:

(a) forming raw material into a hand tool;

(b) hardening the raw material formed into the hand tool by heat treatment;

(c) polishing a surface of the hand tool after hardening;

(d) depositing a nickel layer on the surface of the polished hand tool to provide an anti-rust effect and then depositing a chromium layer on the nickel layer to provide an anti-corrosion effect; and (e) sanding the deposited chromium layer on the nickel layer on the surface of the hand tool at a local area of the hand tool that is grasped during use.

A numerical size area of the hand tool is covered by a local sanding mask device before local sanding to thereby form a clear numerical size mark in the local area after local sanding. The hand tool includes an upper portion, a lower portion, and a mediate portion. The local sanding mask device comprises an upper cap for covering the upper portion of the hand tool and a lower cap for covering the lower portion of the hand tool. One of the upper cap and the lower cap has a mask member thereon. The mediate portion of the hand tool is exposed during the local sanding except for an area covered by the mask member. The mask member is configured to indicate the numerical size of the hand tool.

A hand tool processed by the method in accordance with the present invention provides reliable grasp capability, anti-rust capability, anti-corrosion capability, and clear indication of numerical or physical size.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
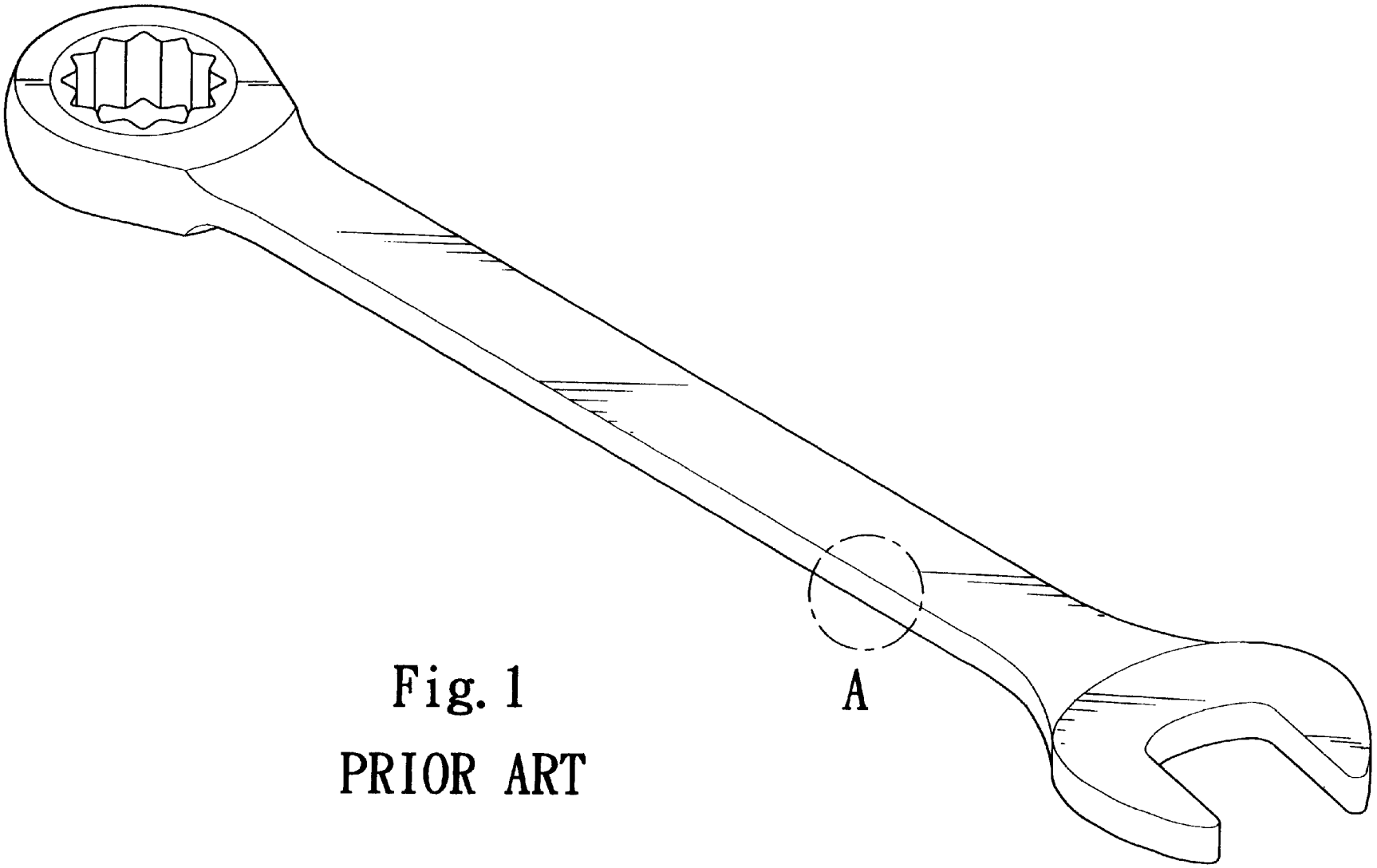
Fig. 1 PRIOR ART
FIG. 1 is a perspective view of a conventional combination wrench treated with surface polishing.
Figure 1A:
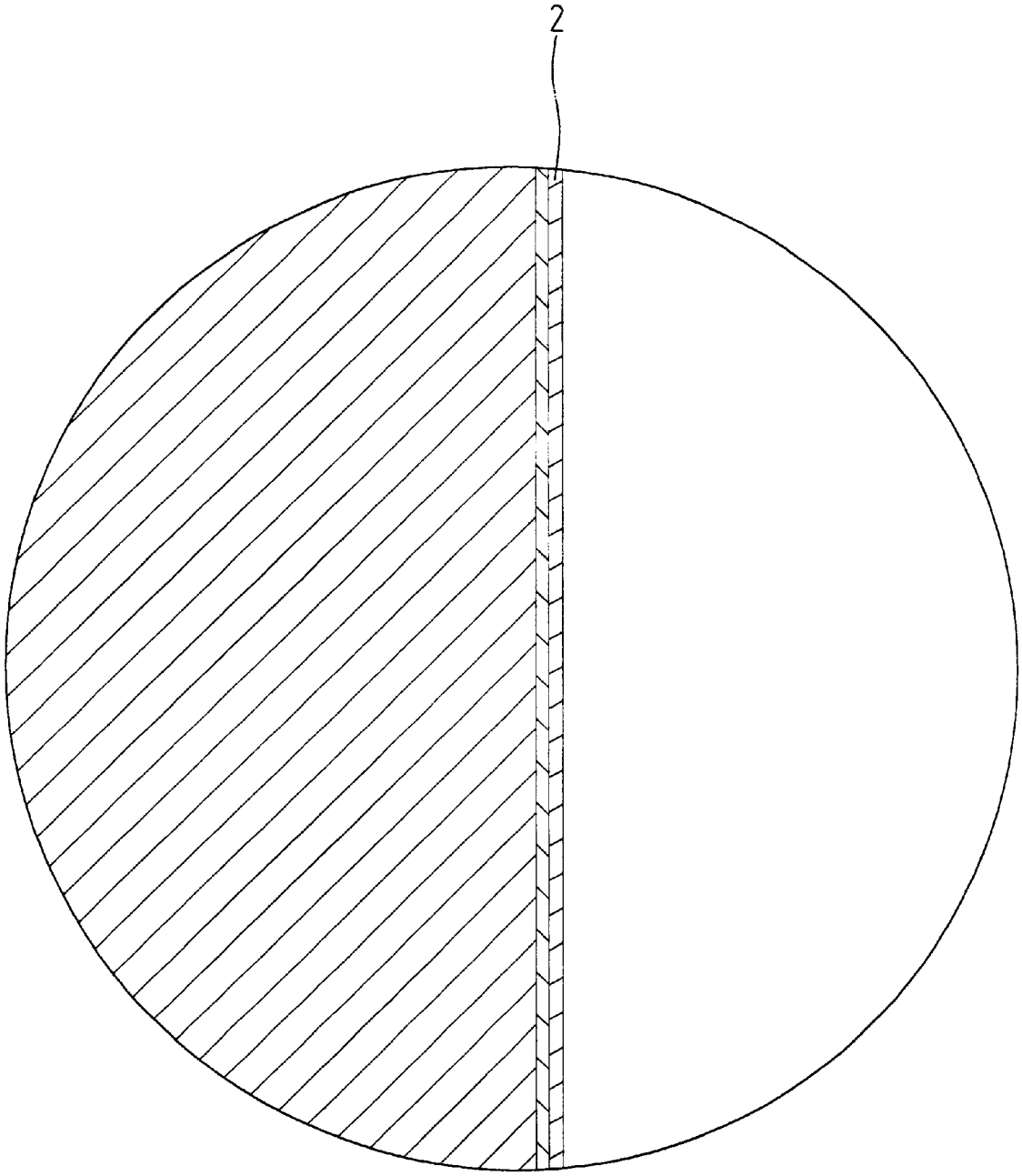
Fig. 1A PRIOR ART
FIG. 1A is an enlarged sectional view of a circle A in FIG. 1.
Figure 2:
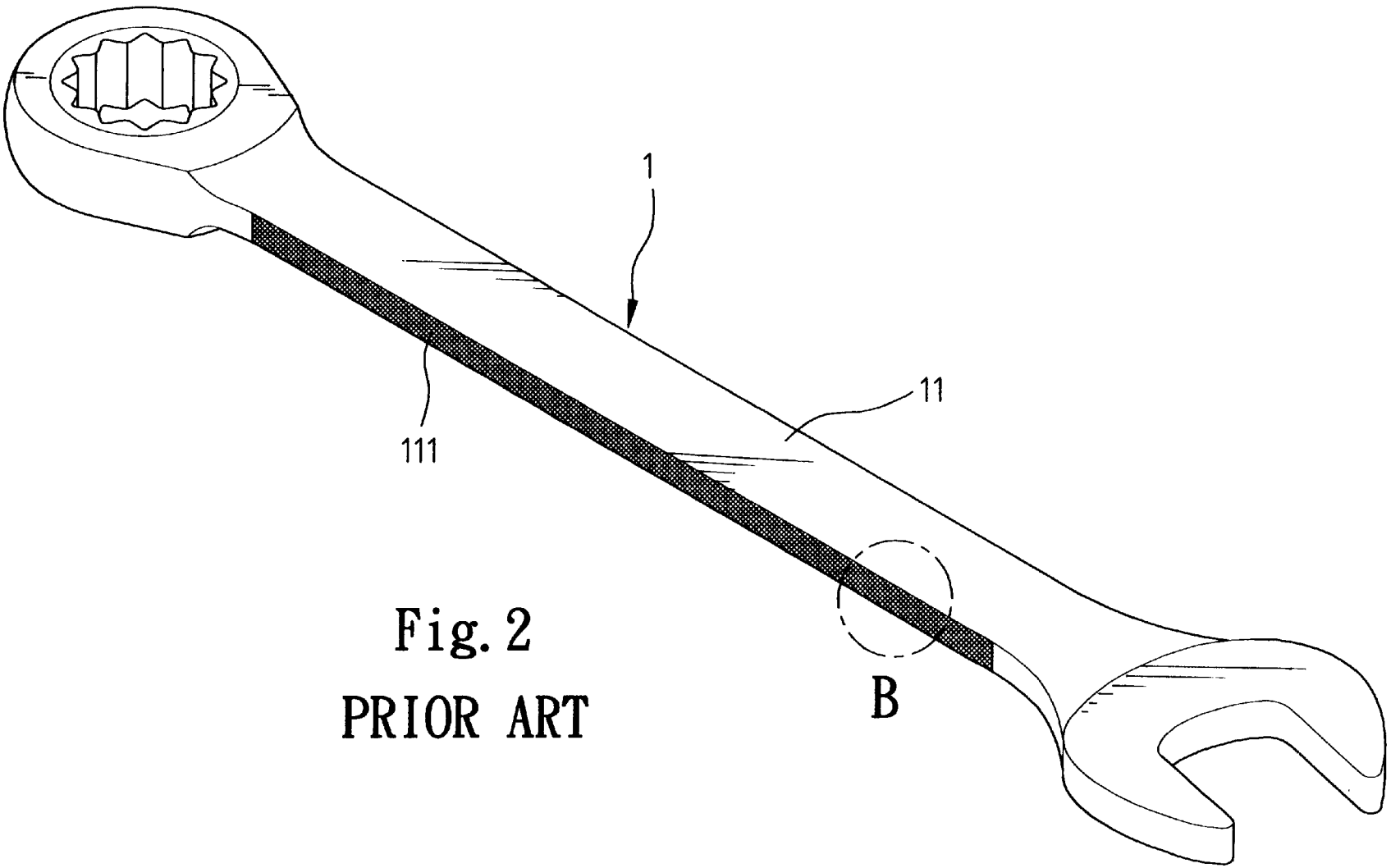
Fig. 2 PRIOR ART
FIG. 2 is a perspective view of another combination wrench with embossed lateral sides.
Figure 2A:
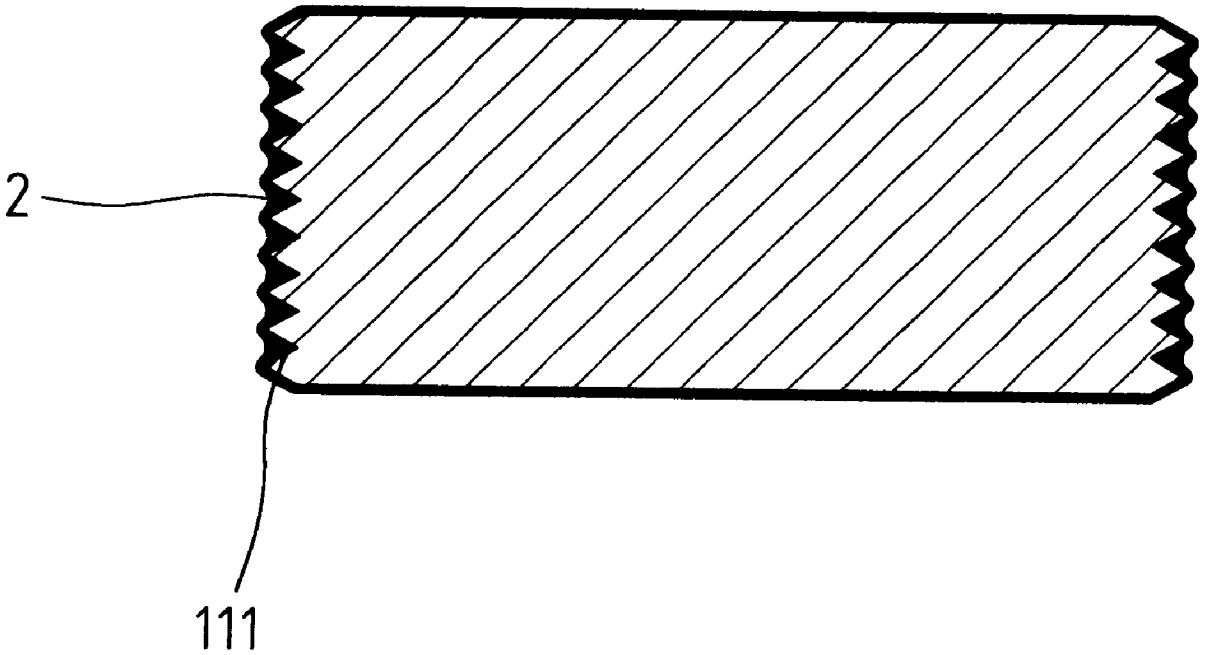
Fig. 2A PRIOR ART
FIG. 2A is an enlarged sectional view of a circle B in FIG. 2.
Figure 3:
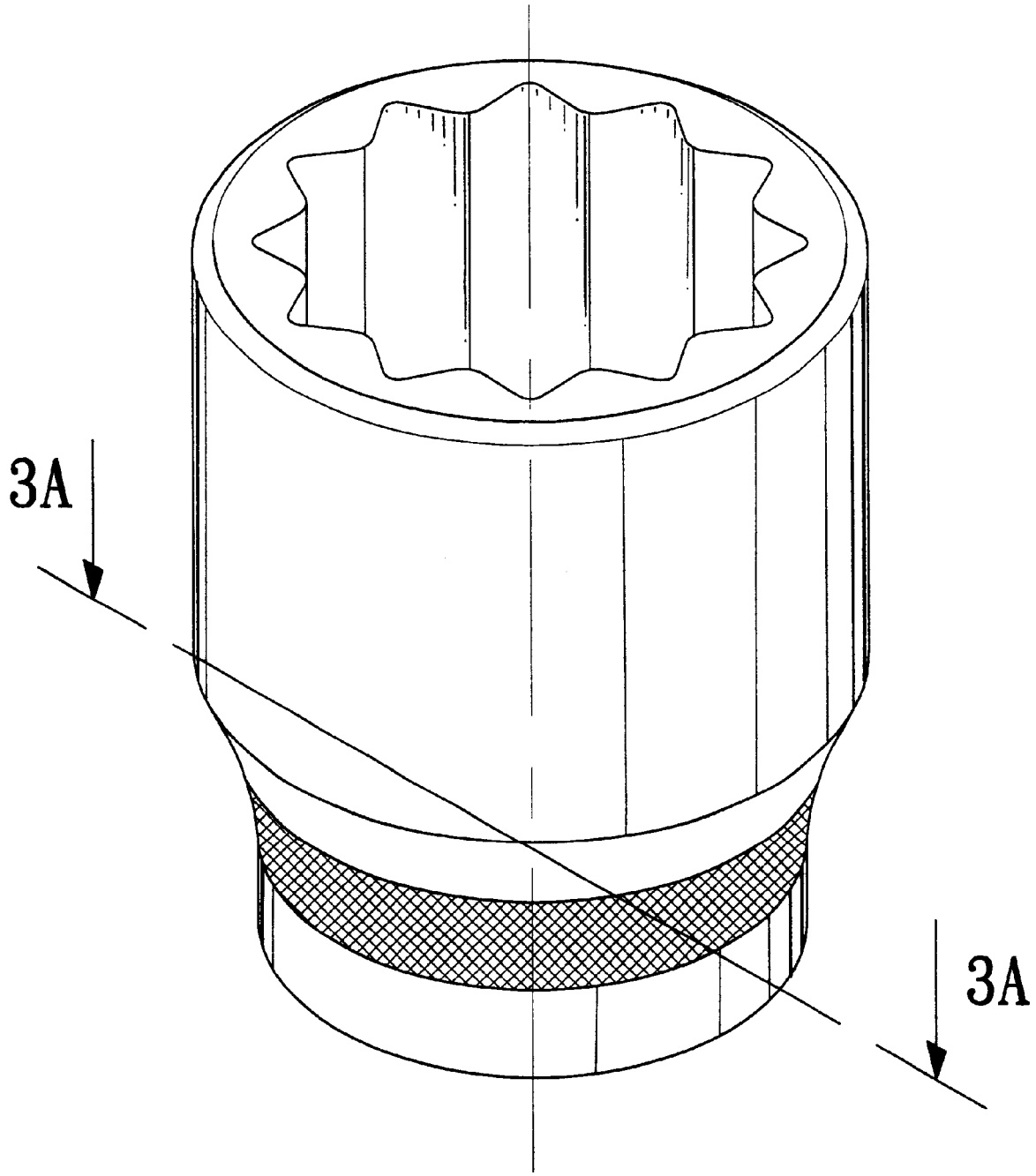
Fig. 3 PRIOR ART
FIG. 3 is a perspective view of a conventional socket with an annular embossed surface section.
Figure 3A:
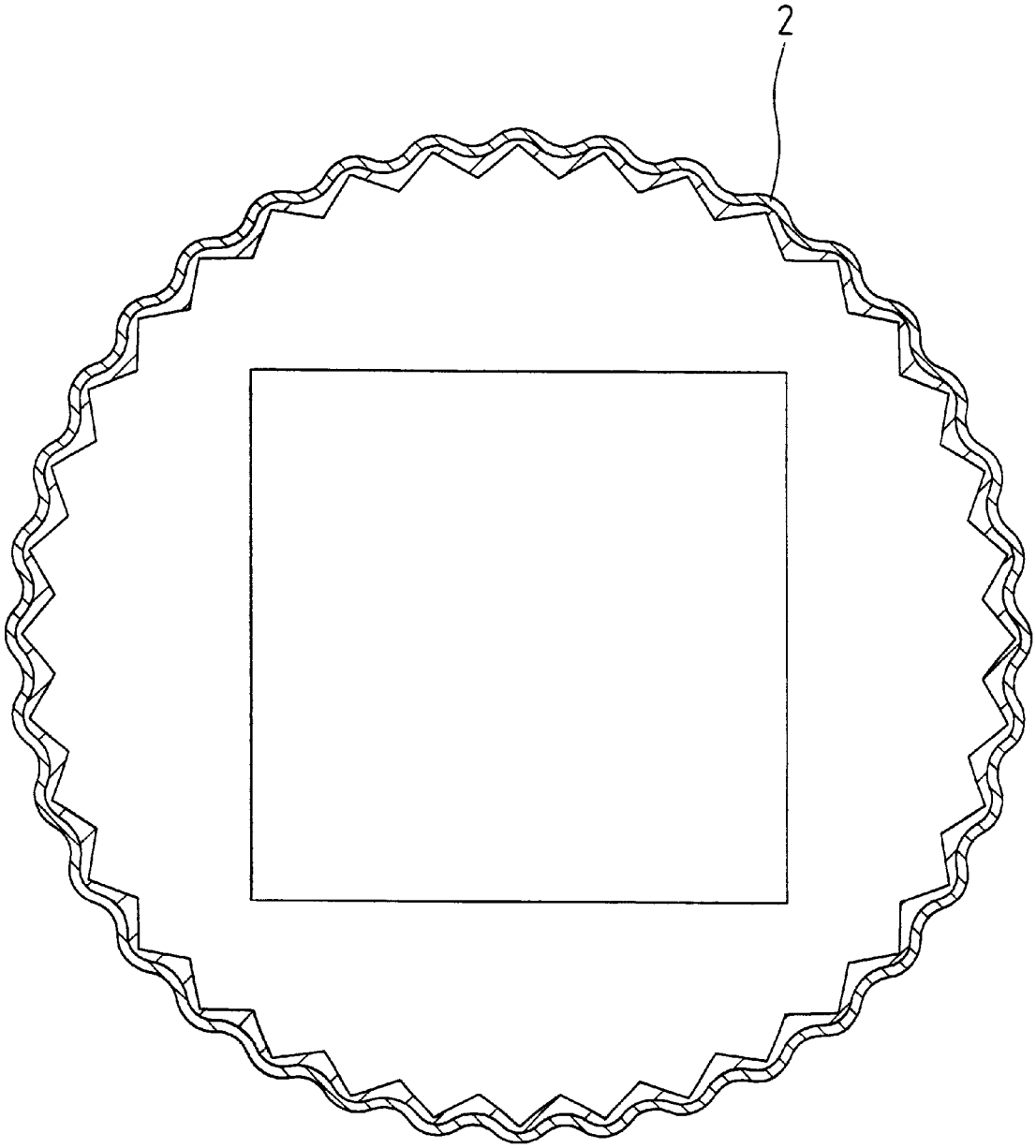
Fig. 3A PRIOR ART
FIG. 3A is an enlarged sectional view taken along line 3A—3A in FIG. 3.
Figure 4:
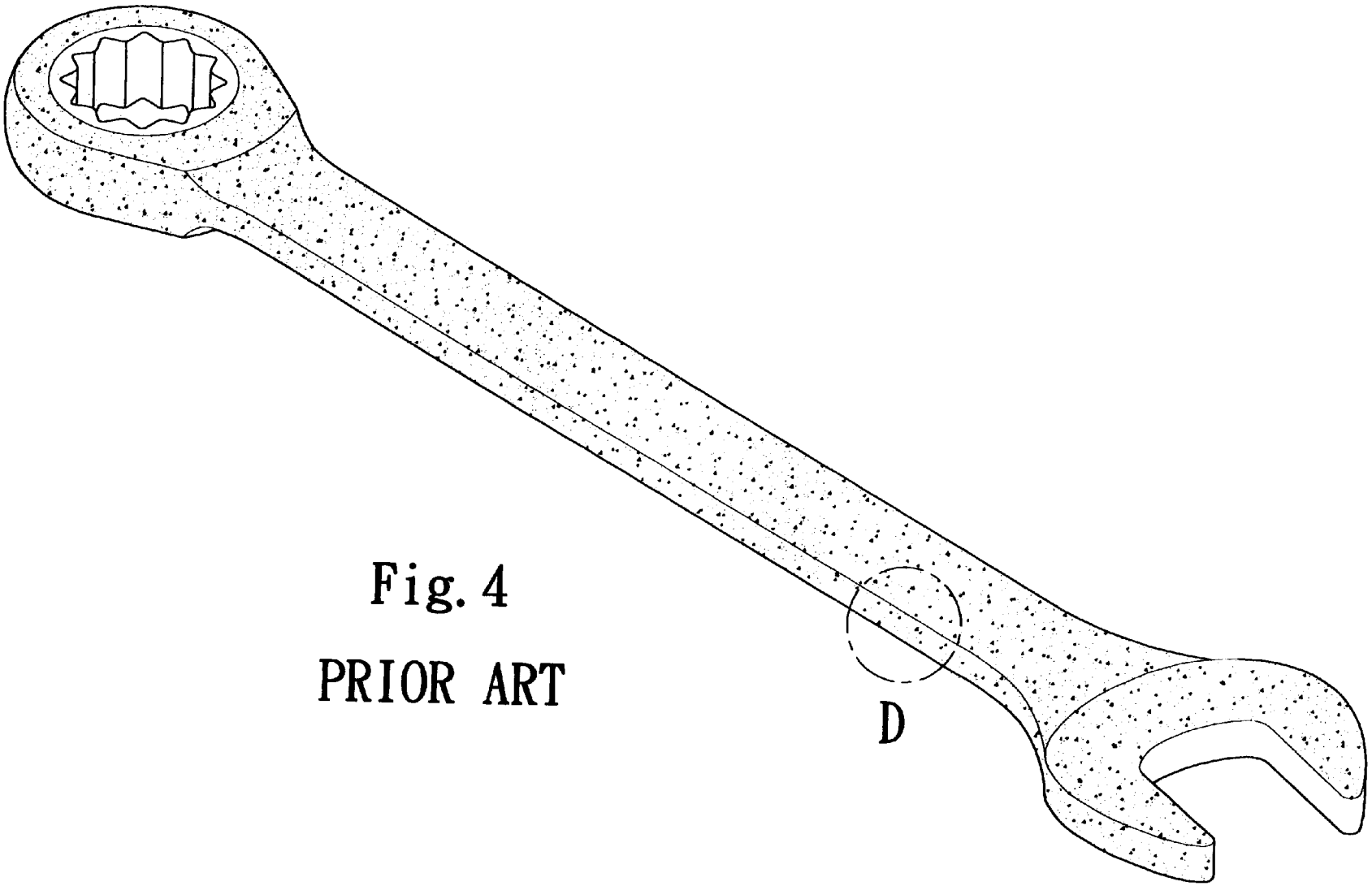
Fig. 4 PRIOR ART
FIG. 4 is a perspective view of a further conventional combination wrench treated with sanding.
Figure 4A:
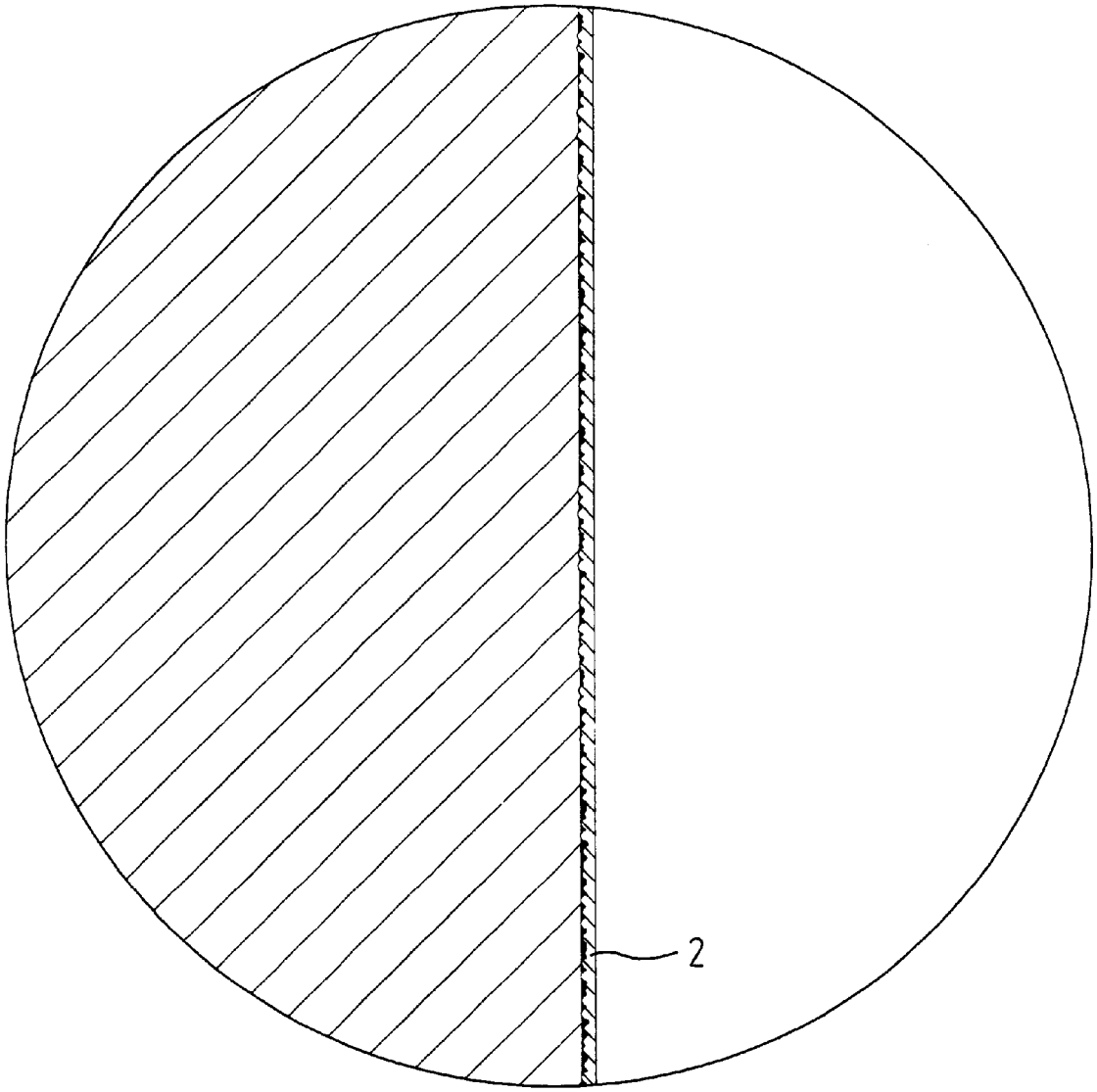
Fig. 4A PRIOR ART
FIG. 4A is an enlarged sectional view of a circle D in FIG. 4.
Figure 5:
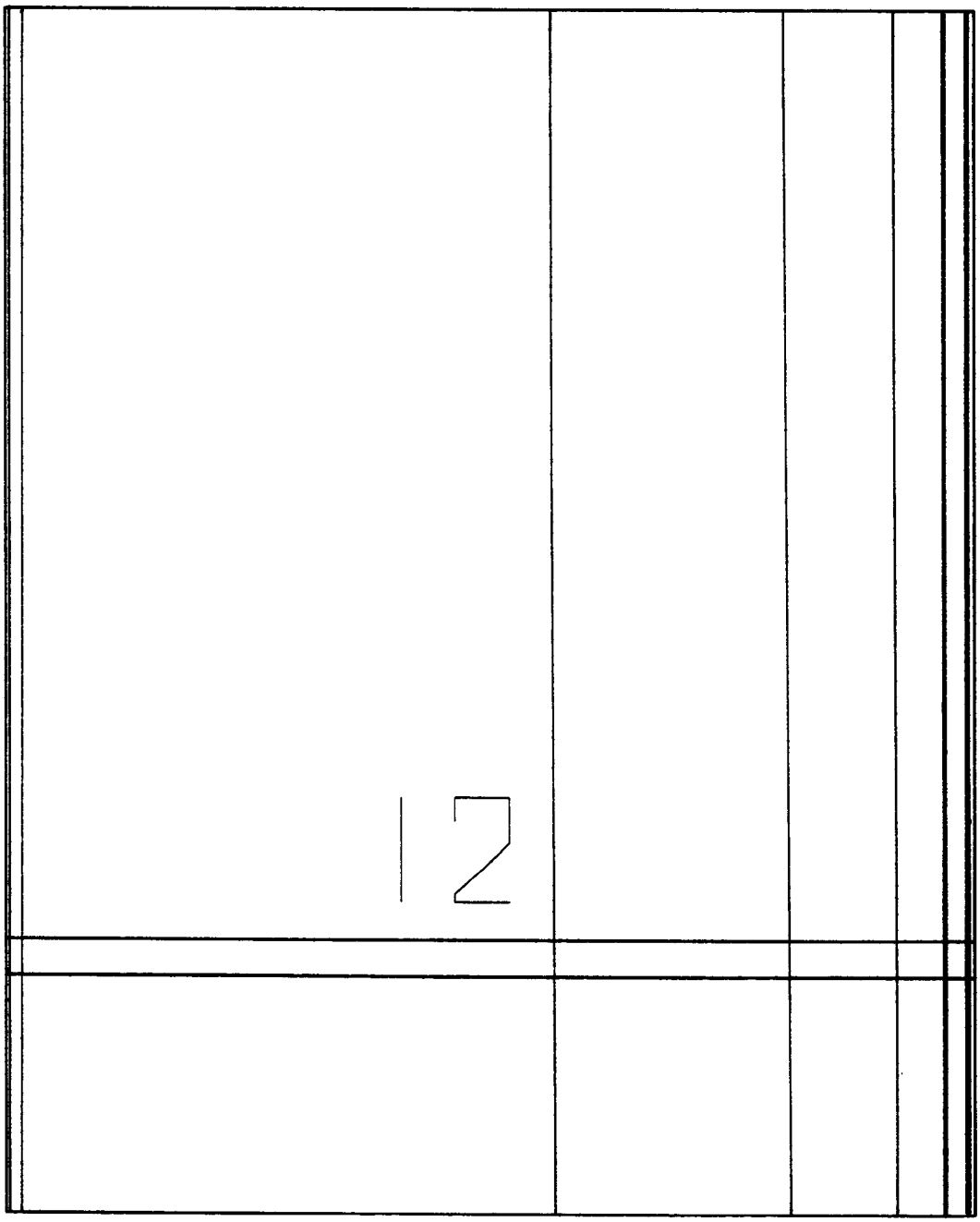
Fig. 5 PRIOR ART
FIG. 5 is a side view of a conventional socket with a numerical size marked thereon.
Figure 6:
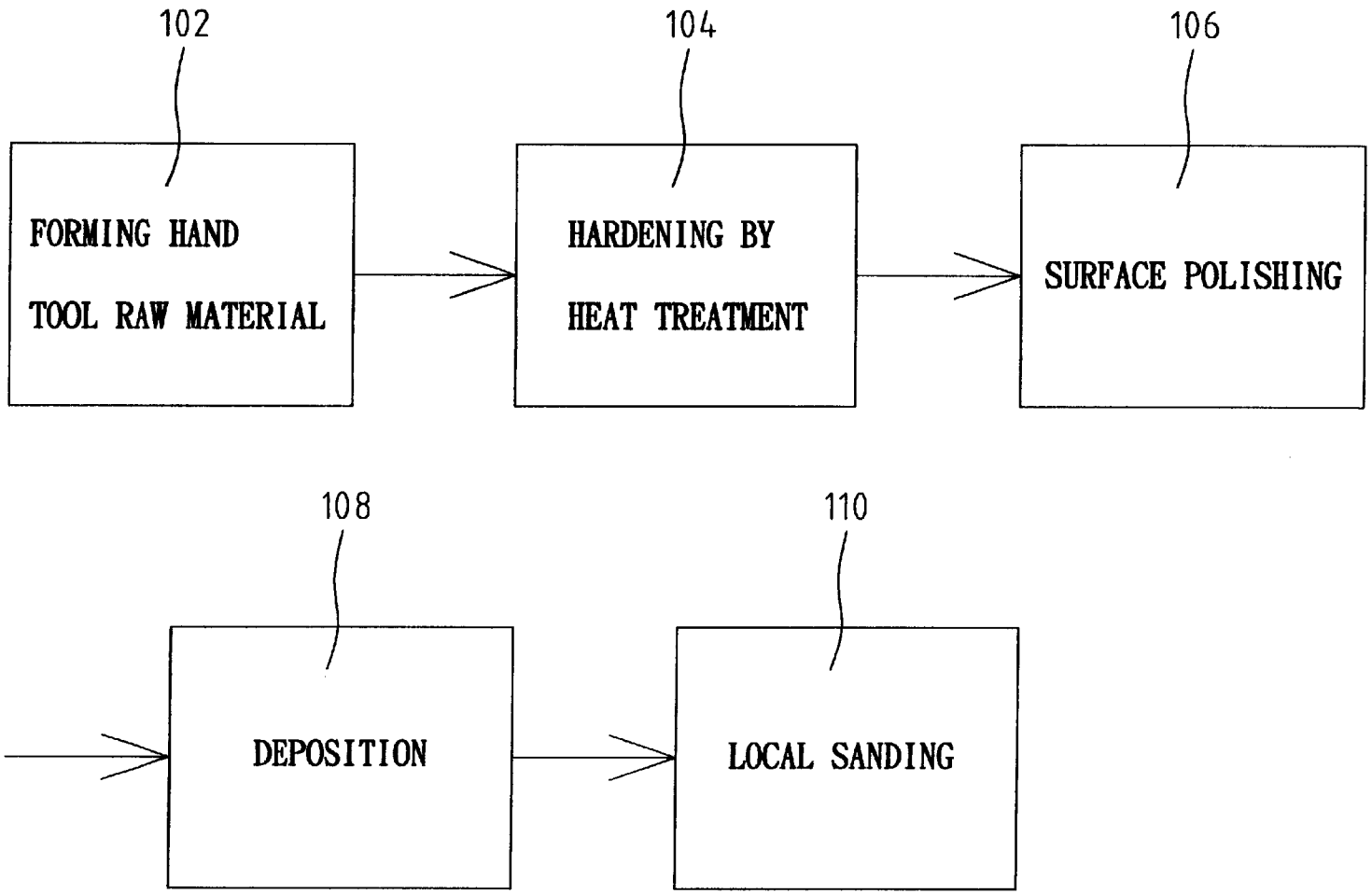
FIG. 6 is a flow chart illustrating a method for processing a hand tool in accordance with the present invention.

Referring to FIGS. 6 through 10 and initially to FIG. 6, a method for processing a hand tool in accordance with the present invention generally includes: (a) forming raw material into a hand tool (step 102), (b) hardening the raw material formed into the hand tool by heat treatment (step 104), (c) polishing a surface of the hand tool after hardening (step 106), (d) depositing a layer of nickel on the surface of the polished hand tool to provide an anti-rust effect and depositing a layer of chromium on the layer of nickel to provide an anti-corrosion effect (step 108), and (e) sanding the deposited layers of nickel and/or chromium on the surface of the hand tool at a local area that is grasped during use (step 110). The local sanding shall not cause damage to the nickel layer and the chromium layer. The nickel layer may be replaced by a copper layer.

Thus, the hand tool processed by the method in accordance with the present invention provides a local surface area for firm grasp capability during use as well as an anti-rust effect and an anti-corrosion effect. In addition, the outer surface of the hand tool processed by the method in accordance with the present invention can be cleaned easily and thus has a higher additional value (i.e., the hand tool can be sold at a higher price).

Figure 7:
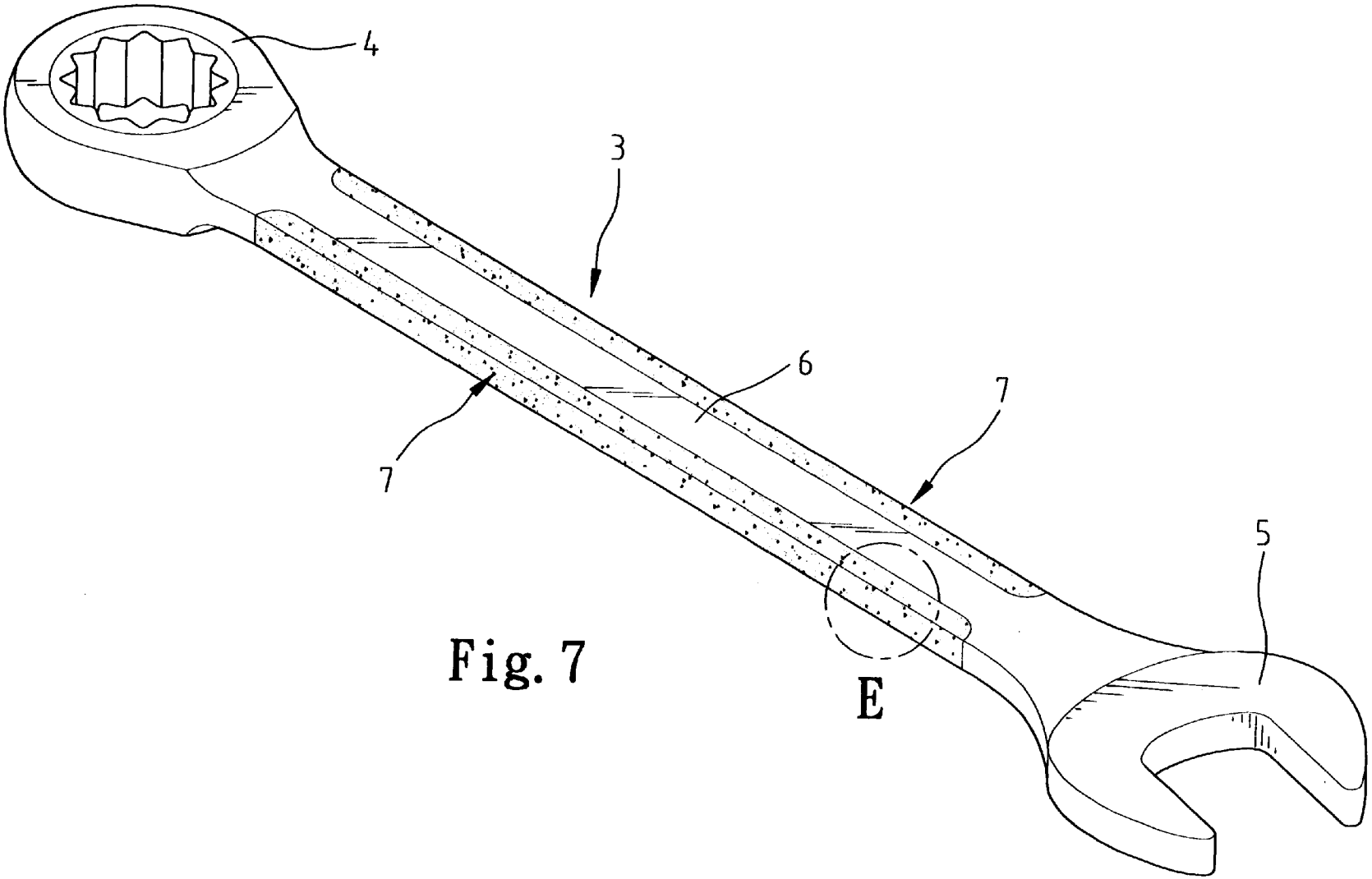
FIG. 7 is a perspective view of a combination wrench treated by the method in accordance with the present invention.
Figure 7A:
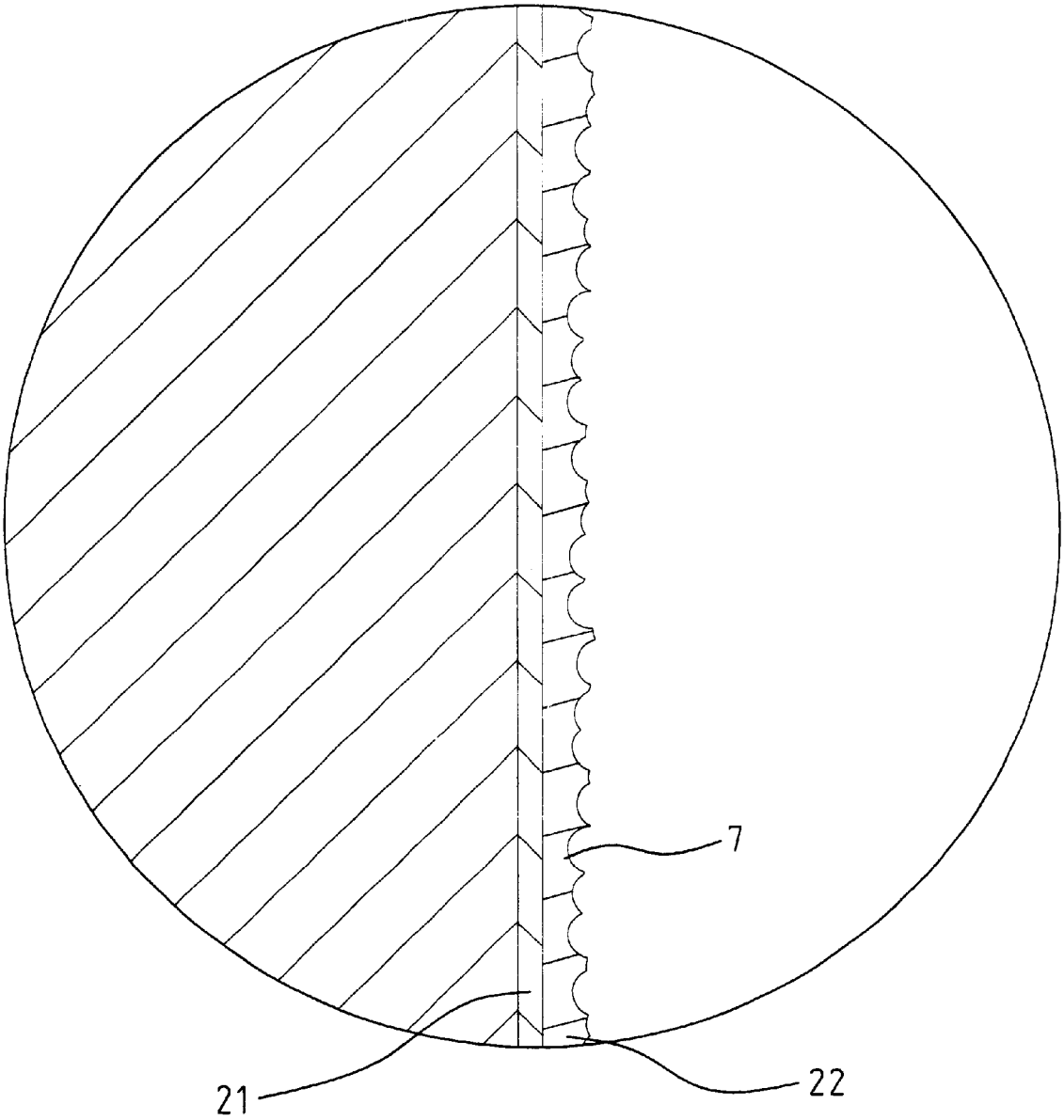
FIG. 7A is an enlarged sectional view of a circle E in FIG. 7.

Referring to FIGS. 7 and 7A, for a combination wrench 3 having a handle 6, a box end 4, and an open end 5, the handle 6 is formed with an anti-slide section 7 on each of two lateral sides thereof to provide reliable grasp during use.

Figure 8:
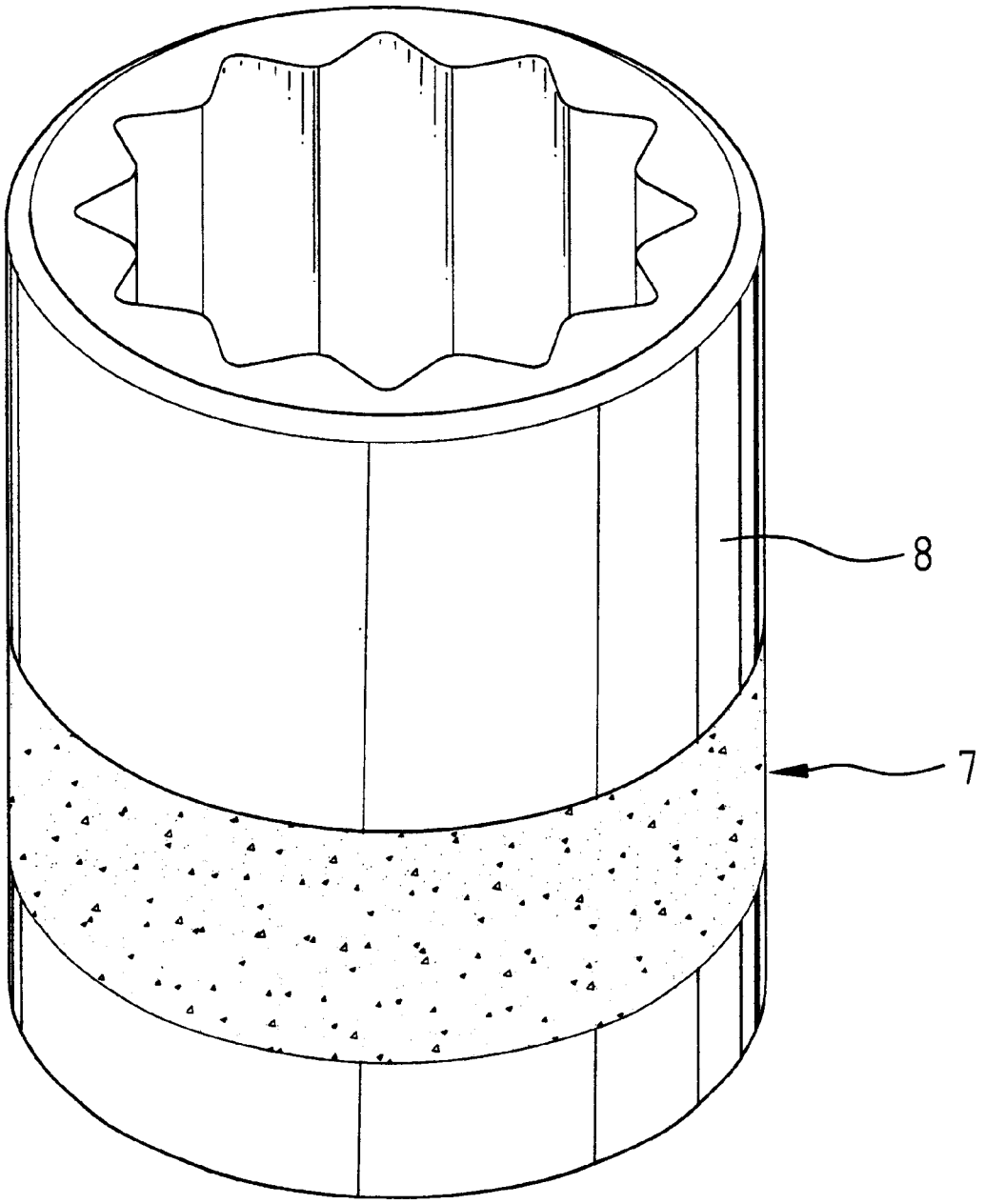
FIG. 8 is a perspective view of a socket treated by the method in accordance with the present invention.
Figure 9:
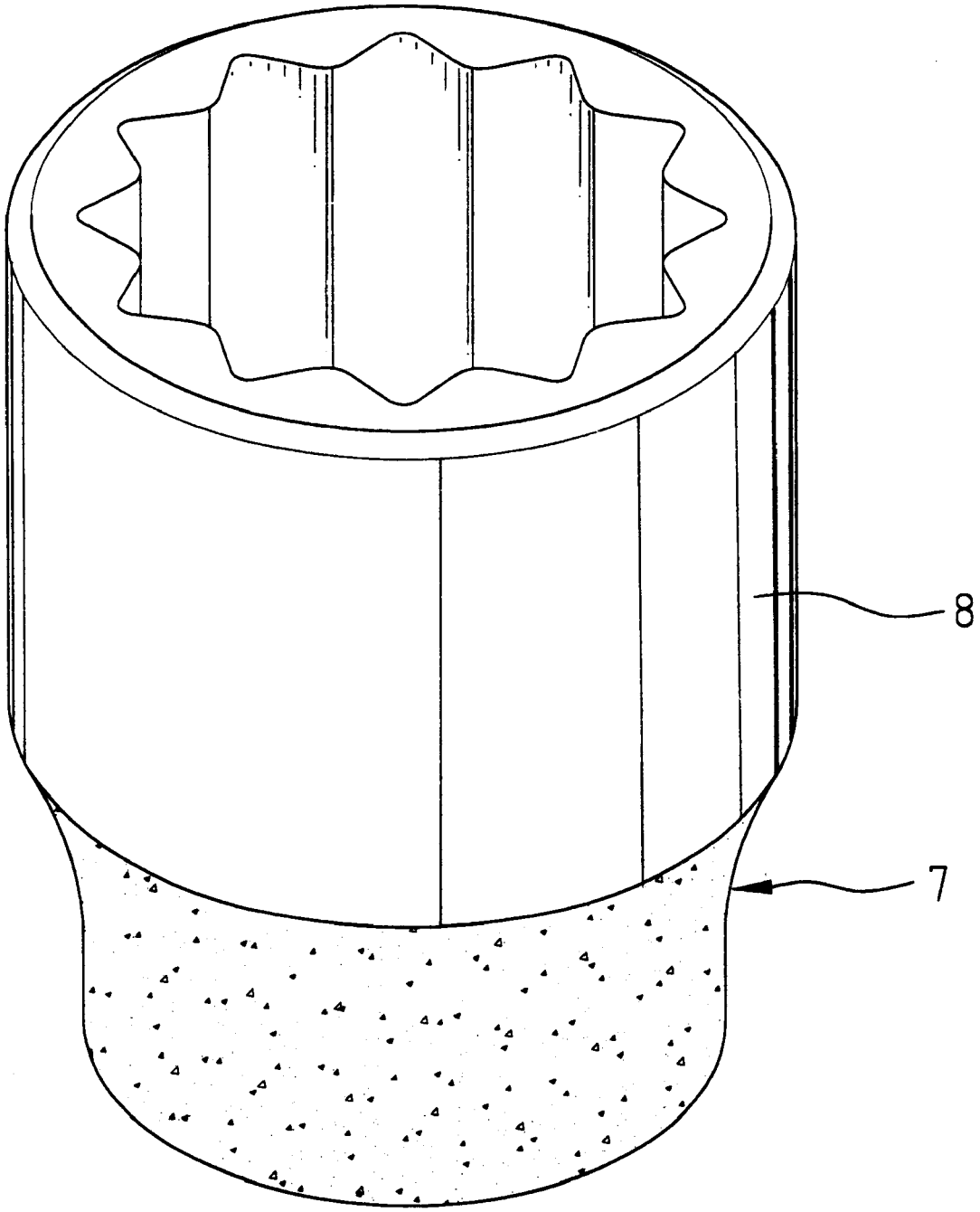
FIG. 9 is a perspective view of a socket of another type treated by the method in accordance with the present invention.

Processing of the combination wrench will be described to provide a full understanding of the method in accordance with the present invention. First, the formed and hardened combination wrench 3 is treated with surface polishing to provide a mirror-like surface, which, in turn, increases the additional value of the combination wrench 3. Deposition is applied to the polished surface of the combination wrench 3 to form an anti-rust nickel layer 21 and an anti-corrosion chromium layer 22 (FIG. 7A). Thereafter, local sanding is provided to the combination wrench 3 after deposition. A sand spraying gun (not shown) is used to spray mist-like sand to a local area of the combination wrench 3 after deposition to form a substantially U-shaped anti-slide section 7 on each of two lateral sides of the handle 6, best shown in FIG. 7. Referring to FIGS. 8 and 9, the method in accordance with the present invention may also be applied to all kinds of sockets to provide a socket 8 with an annular anti-slide section 7 for firm grasp during use.

Figure 10:
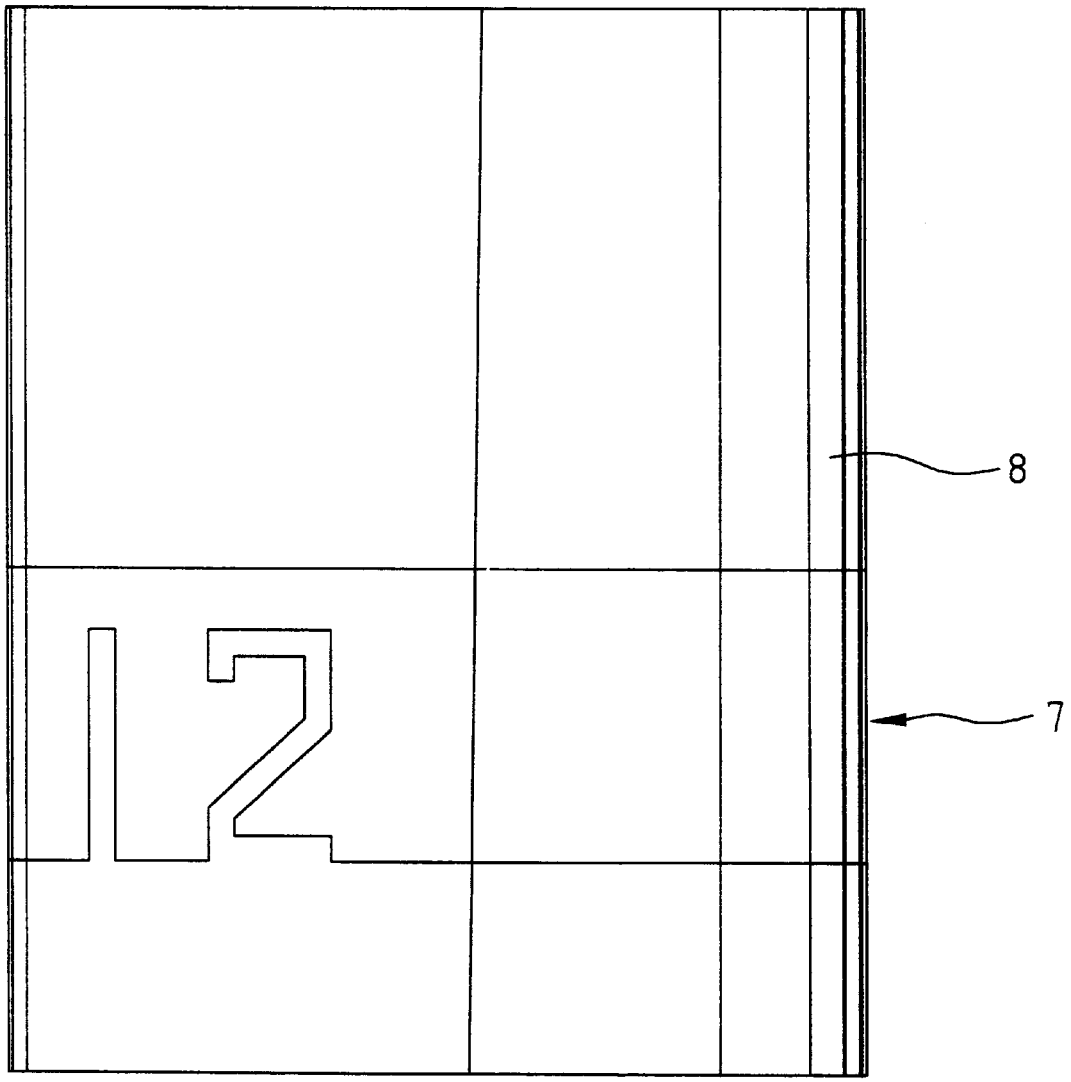
FIG. 10 is a side view of a socket treated by the method in accordance with the present invention and having a clear numerical size marking thereon.
Figure 10A:
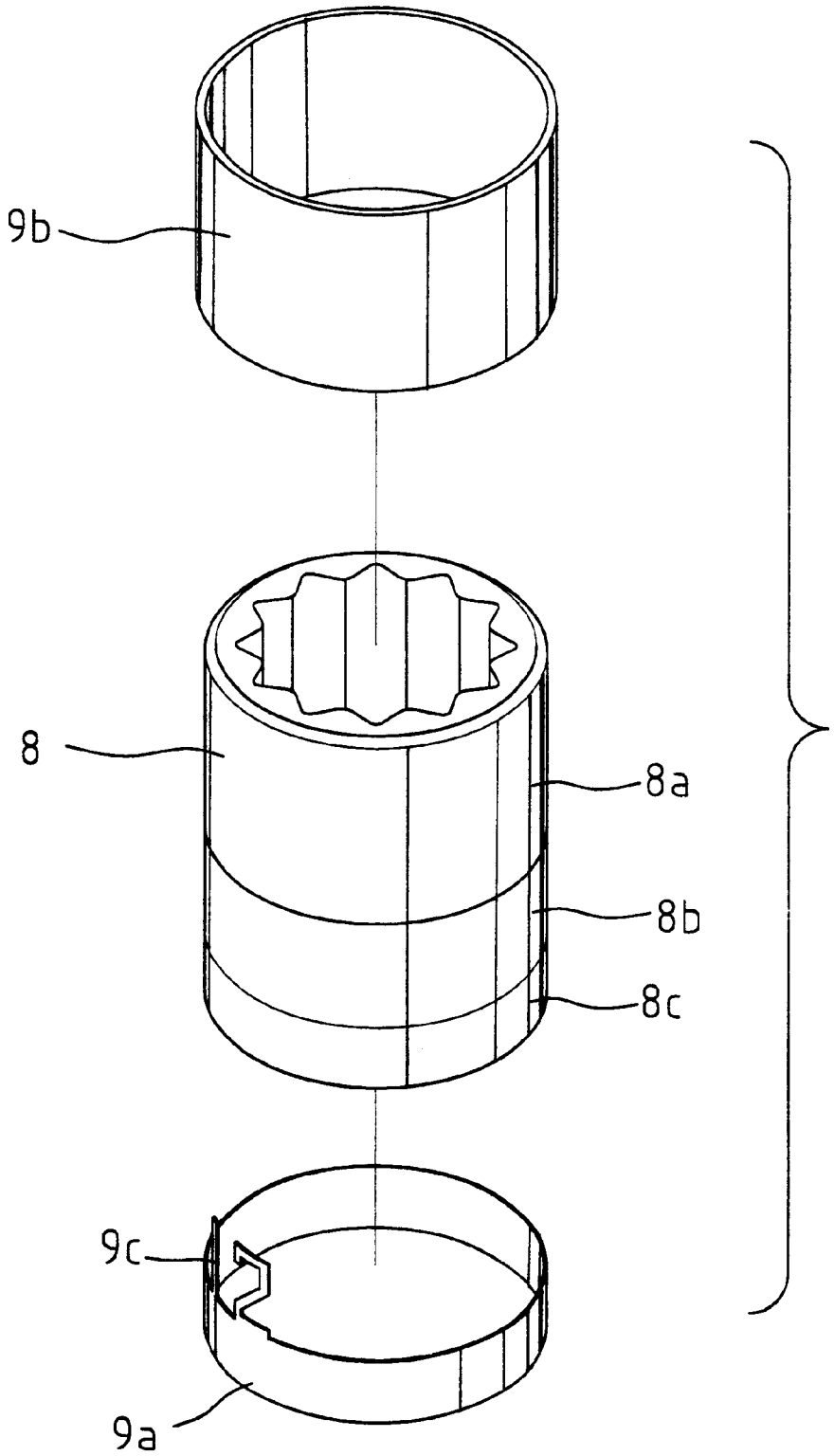
FIG. 10A is an exploded perspective of a socket before local sanding and a local sanding mask device for proceeding with local sanding on the socket.
Figure 10B:
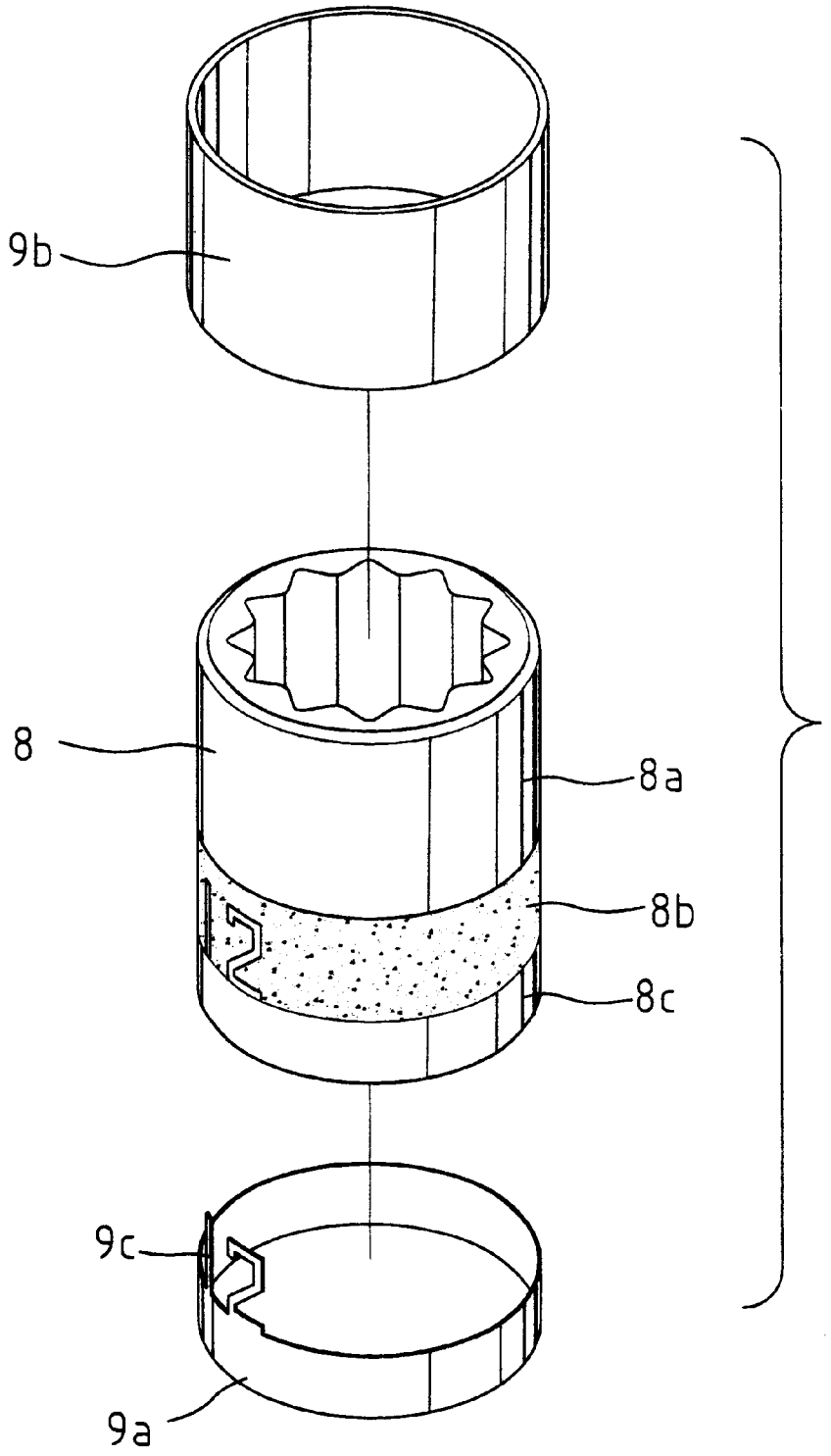
FIG. 10B is an exploded perspective view similar to FIG. 10A, wherein the local sanding procedure on the socket has been finished.

Referring to FIG. 10 and FIG. 10A, in order to provide a clear indication of numerical or physical size of the socket 8, a local sanding mask device is provided to cover the numerical size area (12) before local sanding. In this embodiment, the local sanding mask device includes an upper cap 9*b* for covering an upper portion 8*a* of the socket 8 and a lower cap 9*a* for covering a lower portion 8*c* of the socket 8. A mediate portion 8*b* of the socket 8 is exposed except for an area (not labeled) covered by a mask member 9*c* on the lower cap 9*a*. Alternatively, the mask member 9*c* can be formed on the upper cap 9*b*. The mask member 9*c* is configured to indicate the numerical size (12) of the socket 8, i.e. the size of the fastener intended to be received in socket 8. Thus, after spraying mist-like sand over the exposed mediate portion 8*b* by a sand spraying gun (not shown) (local sanding) and removing the local sanding mask device, an anti-slide section 7 is formed on the mediate portion 8*b* of the socket 8. It is noted that a clear numerical size mark (12) formed by a smooth shining surface area (as a result of the polishing procedure accomplished before the local sanding procedure) is provided in the anti-slide section 7. The anti-slide section 7 of the socket 8 is a relatively darker light-absorbing section while the numerical size mark (12) provides a shiny section. Thus, the numerical size mark can be seen in a clear manner even in a relatively dark place, as a contrast is provided.

According to the above description, it is appreciated that a hand tool processed by the method in accordance with the present invention provides reliable grasp capability, anti-rust capability, anti-corrosion capability, and clear indication of numerical size.

Although the invention has been explained in relation to its preferred embodiment, it is to be understood that many other possible modifications and variations can be made without departing from the spirit and scope of the invention as hereinafter claimed.

What is claimed is:

1. A method for processing a hand tool, comprising:

(a) forming raw material into a hand tool;

(b) hardening the raw material formed into a hand tool;

(c) polishing a surface of the hand tool after hardening;

(d) depositing a layer of metal on the surface of the polished hand tool; and (e) creating an anti-slide section on the hand tool that is grasped by a user during use by sanding the deposited layer on the surface of the hand tool that is grasped during use.

2. The method for processing a hand tool as claimed in claim 1, wherein the metal is nickel.

3. The method for processing a hand tool as claimed in claim 1, with sanding the deposited layer comprising sanding at the local area of a size smaller than the deposited layer on the surface.

4. The method for processing a hand tool as claimed in claim 3, further comprising covering a mark area of a size less than the local area by a local sanding mask device in the local area before local sanding, thereby forming a clear mark in the local area after local sanding.

5. The method for processing a hand tool as claimed in claim 4, wherein the hand tool includes an upper portion, a lower portion, and a mediate portion, the local sanding mask device comprising an upper cap for covering the upper portion of the hand tool and a lower cap for covering the lower portion of the hand tool, one of the upper cap and the lower cap having a mask member thereon, the mediate portion of the hand tool being exposed during the local sanding except for the mark area covered by the mask member.

6. The method for processing a hand tool as claimed in claim 5, wherein covering the mark area comprises providing the local sanding mask device configured to indicate the numerical size of the hand tool.

7. The method for processing a hand tool as claimed in claim 1, wherein the metal is chromium.

8. The method for processing a hand tool as claimed in claim 1, wherein depositing the layer of metal comprises depositing a nickel layer on the surface of the polished hand tool to provide an anti-rust effect and then depositing a chromium layer on the nickel layer to provide an anti-corrosion effect.

9. The method for processing a hand tool as claimed in claim 8, further comprising covering a mark area of a size less than the local area by a local sanding mask device in the local area before local sanding, thereby forming a clear mark in the local area after local sanding.

10. The method for processing a hand tool as claimed in claim 9, wherein the hand tool includes an upper portion, a lower portion, and a mediate portion, the local sanding mask device comprising an upper cap for covering the upper portion of the hand tool and a lower cap for covering the lower portion of the hand tool, one of the upper cap and the lower cap having a mask member thereon, the mediate portion of the hand tool being exposed during the local sanding except for the mark area covered by the mask member.

11. The method for processing a hand tool as claimed in claim 1, with hardening the raw material comprising hardening the raw material by heat treatment.

12. A method for processing a hand tool, comprising:

(a) forming a raw material into a hand tool;

(b) hardening the raw material formed into the hand tool by heat treatment;

(c) polishing a surface of the hand tool after hardening;

(d) depositing a layer of metal on the surface of the polished hand tool to provide an anti-corrosion effect; and (e) creating an anti-slide section on the hand tool that is grasped by a user during use by sanding the deposited layer on the surface of the hand tool at a local area of the hand tool that is grasped during use.

13. The method for processing a hand tool as claimed in claim 12, further comprising covering a mark area of a size less than the local area by a local sanding mask device located in the local area before local sanding, thereby forming a clear mark in the local area after local sanding.

14. The method for processing a hand tool as claimed in claim 13, wherein the hand tool includes an upper portion, a lower portion, and a mediate portion, the local sanding mask device comprising an upper cap for covering the upper portion of the hand tool and a lower cap for covering the lower portion of the hand tool, one of the upper cap and the lower cap having a mask member thereon, the mediate portion of the hand tool being exposed during the local sanding except for the mark area covered by the mask member.

15. The method for processing a hand tool as claimed in claim 14, wherein covering the mark area comprises providing the local sanding mask device configured to indicate the numerical size of the hand tool.

16. A method for processing a hand tool as claimed in claim 13, with covering the mark area comprising providing the local sanding mask device configured to indicate the numerical size of the hand tool.

17. The method for processing a hand tool as claimed in claim 12, with forming the raw material comprising forming the raw material into the hand tool having a handle including first and second surfaces extending between first and second sides, with sanding the deposited layer comprising sanding the deposited layer at the local area of a substantially U-shape extending over the first side and partially over the first and second surfaces, with the first and second surfaces including portions outside the local area which is free of sanding.

18. The method for processing a hand tool as claimed in claim 12, with forming the raw material comprising forming the raw material into a socket, with polishing the surface comprising polishing the surface in the form of a cylinder having a height, with sanding the deposited layer comprising sanding the deposited layer in a band on the cylinder and having a height less than the height of the cylinder, with the cylinder outside of the band being free of sanding.

19. A method for processing a hand tool, comprising:

(a) forming raw material into a hand tool;

(b) hardening the raw material formed into a hand tool by heat treatment;

(c) polishing a surface of the hand tool after hardening;

(d) depositing a layer of metal on the surface of the polished hand tool;

(e) sanding the hand tool at a local area of the hand tool that is grasped during use; and (f) covering a mark area of a size less than the local area by a local sanding mask device located in the local area before local sanding, thereby forming a clear mark in the local area after local sanding.

20. The method for processing a hand tool as claimed in claim 19, wherein the hand tool includes an upper portion, a lower portion, and a mediate portion, the local sanding mask device comprising an upper cap for covering the upper portion of the hand tool and a lower cap for covering the lower portion of the hand tool, one of the upper cap and the lower cap having a mask member thereon, the mediate portion of the hand tool being exposed during the local sanding except for the mark area covered by the mask member.

21. The method for processing a hand tool as claimed in claim 20, wherein covering the mark area comprises providing the local sanding mask device configured to indicate the numerical size of the hand tool.

22. The method for processing a hand tool as claimed in claim 19, wherein depositing the layer of metal comprises depositing a nickel layer on the surface of the polished hand tool to provide an anti-rust effect and then depositing a chromium layer on the nickel layer to provide an anti-corrosion effect.

23. The method for processing a hand tool as claimed in claim 19, wherein covering the mark area comprises providing the local sanding mask device configured to indicate the numerical size of the hand tool.

* * * * *